US005231703A

United States Patent [19]

Garneau

[11] Patent Number: 5,231,703

[45] Date of Patent: Aug. 3, 1993

[54] PROTECTIVE HEADGEAR

[76] Inventor: Louis Garneau, 246, chemin de la Butte, Saint-Augustin-de-Desmaures, Province of Quebec, Canada, G3A 2E6

[21] Appl. No.: 829,287

[22] Filed: Feb. 3, 1992

[30] Foreign Application Priority Data

May 31, 1991 [CA] Canada ..... 2043725

[51] Int. Cl.[5] ..... A42B 3/02

[52] U.S. Cl. ..... 2/414; 2/425; 2/DIG. 1

[58] Field of Search ..... 2/411, 412, 414, 424, 2/425, 181.6, 181.8, 410, DIG. 1

[56] References Cited

U.S. PATENT DOCUMENTS

| | | | |
|---|---|---|---|
| 3,116,490 | 1/1964 | Zbikowski | 2/414 |
| 4,051,555 | 10/1977 | Daly | 2/412 |
| 4,133,055 | 9/1979 | Zebuhr | 2/411 |
| 4,619,003 | 10/1986 | Asbury | 2/412 X |
| 4,656,667 | 4/1987 | Blake | 2/412 X |
| 4,710,984 | 12/1987 | Asper et al. | 2/412 |
| 4,736,469 | 12/1988 | Boretti | 2/411 |
| 4,796,309 | 10/1989 | Nava | 2/414 |
| 4,845,786 | 7/1989 | Chiarella | 2/425 X |
| 4,996,724 | 5/1991 | Dextrase | 2/411 |
| 5,119,516 | 6/1992 | Broersma | 2/411 |

FOREIGN PATENT DOCUMENTS

| | | | |
|---|---|---|---|
| 718684 | 9/1965 | Canada . | |
| 868101 | 4/1971 | Canada . | |
| 1200052 | 4/1986 | Canada . | |
| 0096148 | 12/1983 | European Pat. Off. | 2/411 |

*Primary Examiner*—Peter Nerbun

*Attorney, Agent, or Firm*—Pierre Lespérance; Francois Martineau

[57] ABSTRACT

A safety helmet comprises hard internal and external shells and a shock-absorbent insert. The internal shell forms at its lower edge and on the outside thereof an upwardly-opening trough in which the insert is inserted. The free edge of the trough joins with the lower edge of the external shell above the bottom of the trough. The two shells, together with the insert, form ventilation openings which are lined by portions of the two shells. In one embodiment, the internal shell lines all of the interior face of the helmet. In another embodiment, the main portion of the internal shell is embedded into the soft-bodied insert, so that it is mainly the insert that contacts the wearer's head, but for the rim portion thereof where the internal shell still surrounds the bottom edge of the insert.

1 Claim, 6 Drawing Sheets

PROTECTIVE HEADGEAR

FIELD OF THE INVENTION

The present invention relates to safety or protective helmets for cyclists heads.

BACKGROUND OF THE INVENTION

Conventional safety helmets comprise an impact resistant, hard external shell and an inner shock-absorbent liner which is contoured to fit and protect the head of the wearer. Usually, the shock-absorbent portion of the helmet is made of a low-density soft material, such as expanded polystyrene foam, which is easily damaged and soiled during handling.

U.S. Pat. No. 4,996,724 dated Mar. 5, 1991 and entitled: PROTECTIVE RIM CONFIGURATION FOR HARD SHELL SAFETY HELMET—inventor: Serge Dextrase, partially overcomes the above-noted disadvantage, by providing a rim configuration made of the same hard material as the external shell and covering the lower periphery of the external shell. However, in such a helmet, the polystyrene foam is still left exposed inside the helmet.

In order to have sufficient impact resistance, the liner of such a helmet must be relatively thick or the foam material of said liner must have a relatively high density, for instance 6 pounds per cubic foot.

Another problem with existing safety helmets is that, once they have sustained a first major blow, they tend to fracture, become fragmented and to fall apart—the fragmented parts thereof release one another. This is to say, the helmet disintegrates. This is unfortunate, since in high-speed cycling accidents, multiple ground impacts of the head are not uncommon. If the helmet has already fragmented and disintegrated after the first ground impact, it becomes useless in preventing head injuries for the following ground impacts of the behelmeted cyclist.

OBJECTS OF THE INVENTION

It is the general object of the present invention to provide a safety helmet of the character described, which is provided with an internal shell as well as an external shell, the internal shell being made of hard material and substantially covering the inner surface of the shock-absorbent liner.

Another object of the present invention is to provide a safety helmet of the character described, in which all the surfaces of the shock-absorbent liner, including those at the ventilation openings, are covered and coated by the hard internal and external shells.

Another object of the present invention is to provide a safety helmet of the character described, of minimum weight and yet of maximum resistance to impact.

An important object of the invention is to provide an alternate embodiment of such helmet, having means to capture and retain to the helmet fragments of impacted parts thereof, wherein a major portion of the internal shell is embedded into the soft-bodied insert part of the helmet.

SUMMARY OF THE INVENTION

The safety helmet of the invention is especially designed for cyclists and comprises a hard external shell, a hard internal shell, and an intermediate shock-absorbing insert. The internal shell defines a bottom rim portion formed by an outwardly-extending web and a flange projecting upwardly from the web, the bottom rim portion thus defining an upwardly-opening trough, said insert conforming with and adhering to the outer surface of said internal shell and filling said trough, said external shell intimately conforming with, and adhering, to the external surface of said insert and having a bottom edge forming a joint with the top edge of the flange, and ventilating opening extending through the internal shell, the insert and the external shell.

Preferably, the internal and external shells form tube-like extensions surrounding their respective portions of the ventilating openings and protruding from the inner surface of the external shell, and from the outer surface of the internal shell, respectively, the extensions of the external shell butting the extensions of the internal shell, said extensions thus forming a liner coating the surfaces of the insert which would otherwise be exposed in said ventilation openings.

In an alternate embodiment of the invention, the major portion of the inner face of the internal shell is embedded thicknesswisely into the soft-bodied insert of the insert, rather than being applied against the outer face thereof as in the first embodiment, so as to provide increased capability of maintaining together impact fragments of the shattered helmet.

DETAILED DESCRIPTION OF PREFERRED EMBODIMENTS

Figure 1:
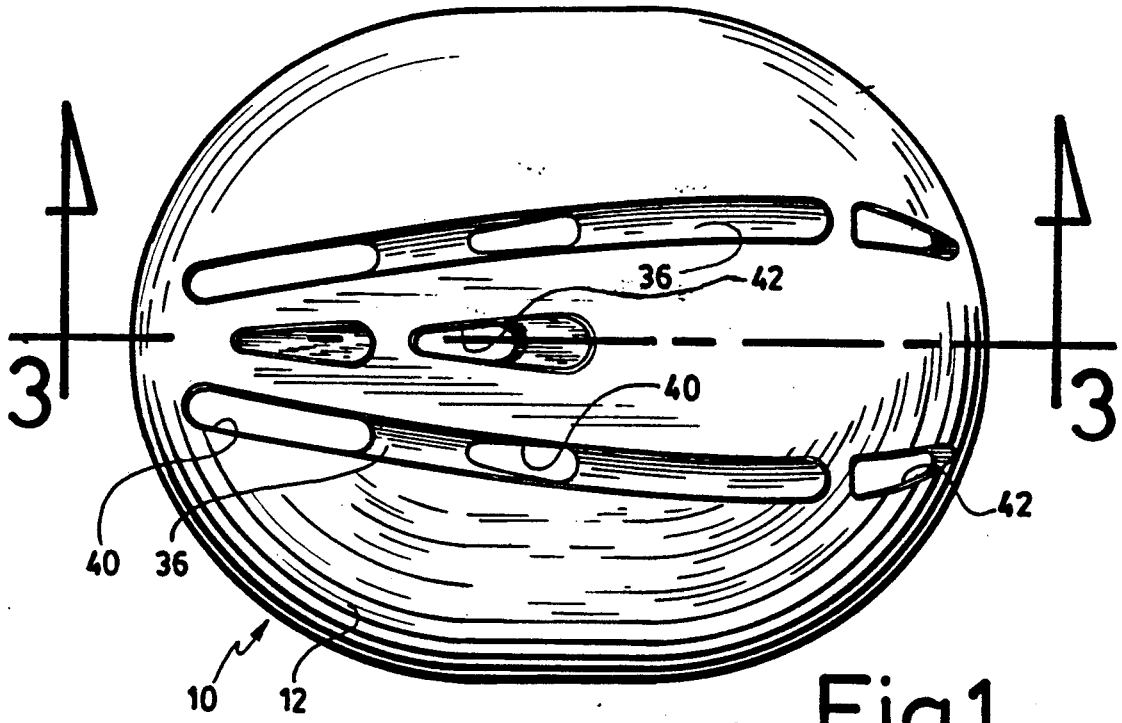
FIG. 1 is a top plan view of the safety helmet according to a first embodiment of the invention.
Figure 2:
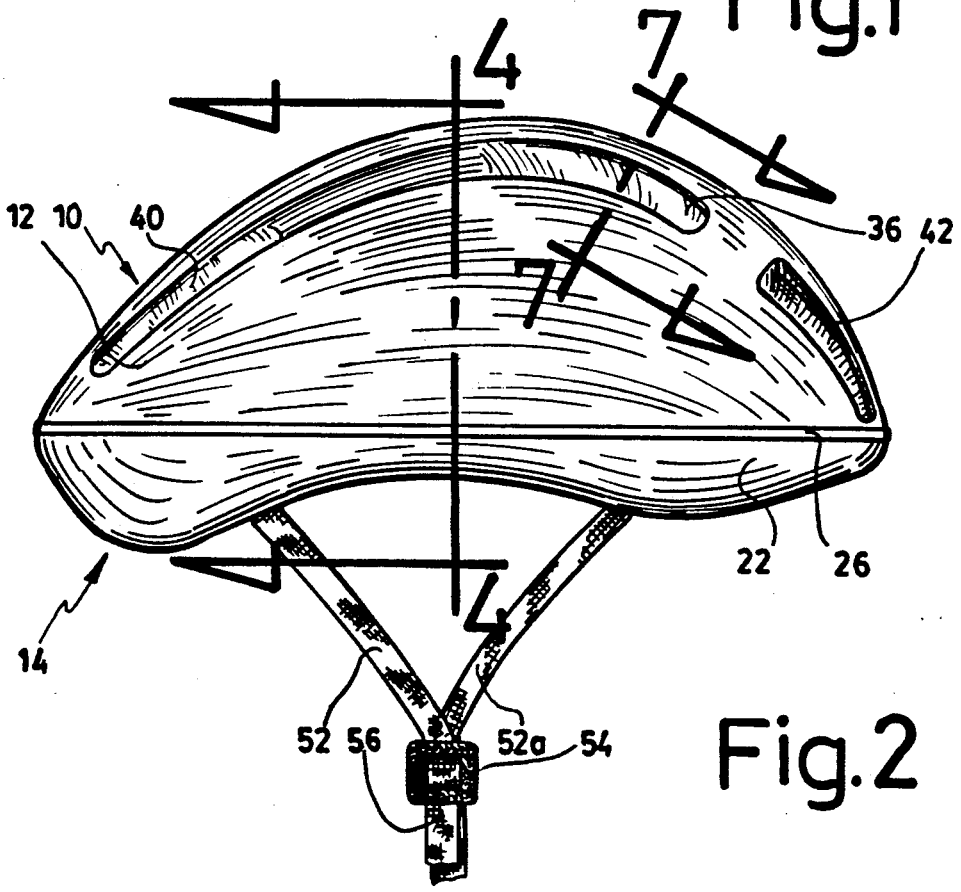
FIG. 2 is a side elevation of the helmet of FIG. 1.

The protective headgear, or more commonly named safety helmet 10 of the invention, comprises an external shell 12, an internal shell 14, and a shock-absorbing insert 16. Both shells 12 and 14 are made of hard yet resiliently flexible material, such as ABS, or similar thermoplastic material. Preferably, each shell 12, 14 has a thickness of about 0.3 millimeters. The insert 16 is made of light weight, soft yet substantially rigid, shock-absorbing material, preferably expanded polystyrene foam. The insert 16 preferably has a non-uniform thickness averaging about 30 millimeters. Instead of the usual density of 6 pounds per cubic foot, found in the foam portions of prior art safety helmets, the helmet of the invention has been provided with the insert having a density of only 3.5 pounds per cubic foot.

Such a lower density helmet insert has recently been certified (in August 1991) by the Snell Memorial Foundation, inc. (St. James, N.Y.) as having demonstrated compliance with the performance requirements under the B-90 standard for protective headgear. It therefore meets safety standards for cyclists, even though its density is almost half that of conventional helmet inserts.

From this, it is clear that, providing a full internal shell considerably increases the helmet resistance to impact. Therefore, providing an internal shell 14, which covers the wearer's head, provides a structural function for the helmet in that it has a synergistic effect with the external shell and insert.

The internal shell 14 is provided at its lower periphery with a bottom rim portion, indicated at 18, formed by an outwardly-extending web 20 and a flange 22 projecting upwardly from the web 20. Thus, the rim portion 18 forms an upwardly-opening trough surrounding internal shell 14 and which is completely filled by the bottom portion of the insert 16. The external shell 12 terminates downwardly short of the bottom portion of the insert 16, and its lower edge forms a joint 24 with the top edge of the flange 22.

Figures 3, 5, 5A, 6:
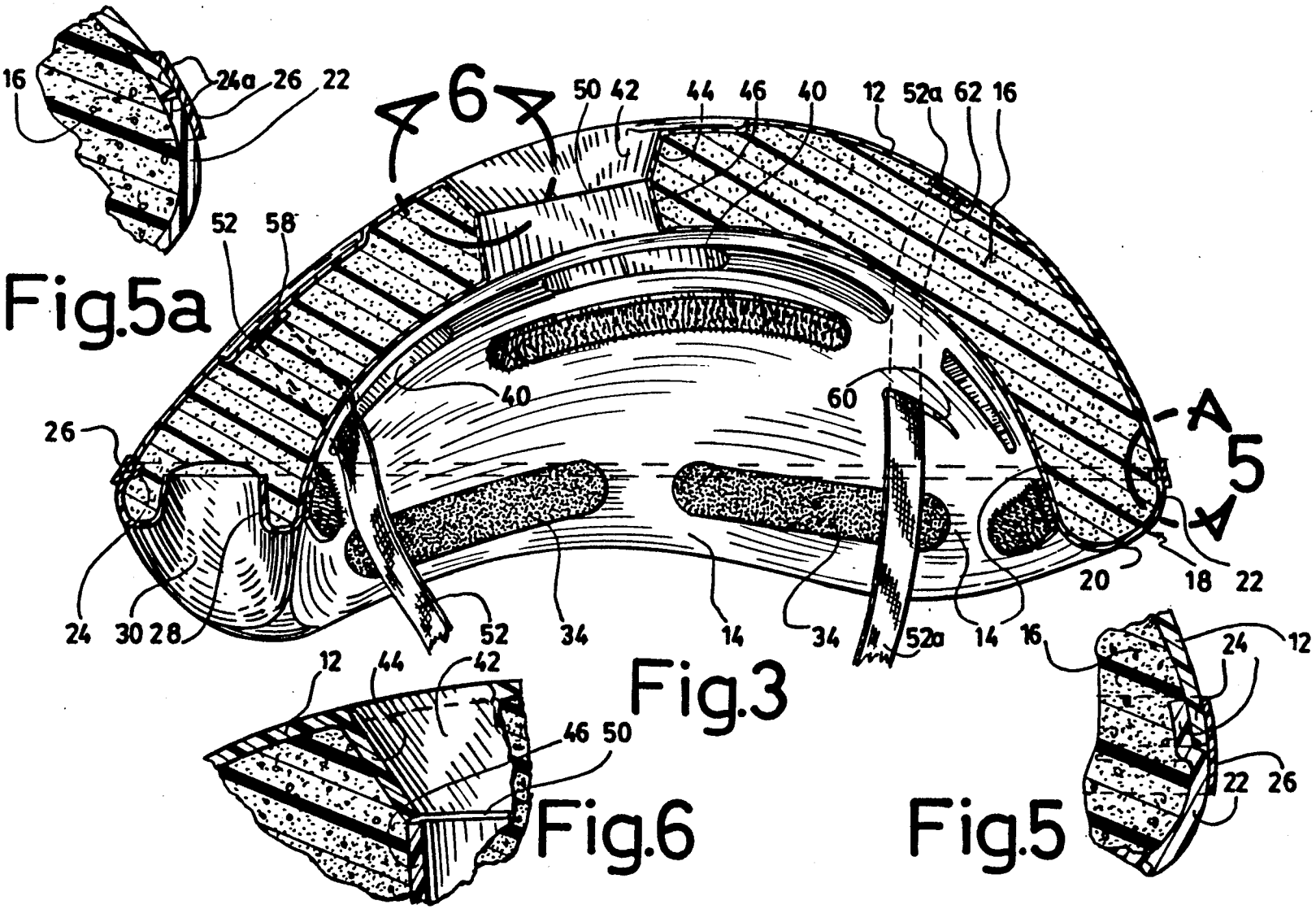
FIG. 3 is a longitudinal section, taken along line 3—3 of FIG. 1.
FIG. 5, on the second sheet of drawings, is an enlarged view of the area circumscribed by circle 5 in FIGS. 3 or 4, and particularly showing the joint between the internal and external shells.
FIG. 5*a* is a partial section similar to FIG. 5 but showing another type of joint.
FIG. 6 is an enlarged view of the area circumscribed by circle 6 of FIGS. 3 or 4.

The joint 24 is preferably a lap joint, as shown in FIG. 5, but can be a butt joint, as shown at 24*a* in FIG. 5*a*. In both cases, the joint is preferably covered, for aesthetic purposes, by a strip 26 adhered to the flange 22 and to the adjacent portion of the external shell 12. Strip 26 completely surrounds the helmet 10.

Internal shell 14 conforms with, and is adapted to cover, the wearer's head, including part of the forehead and the back of the head just above the neck.

Figure 4:
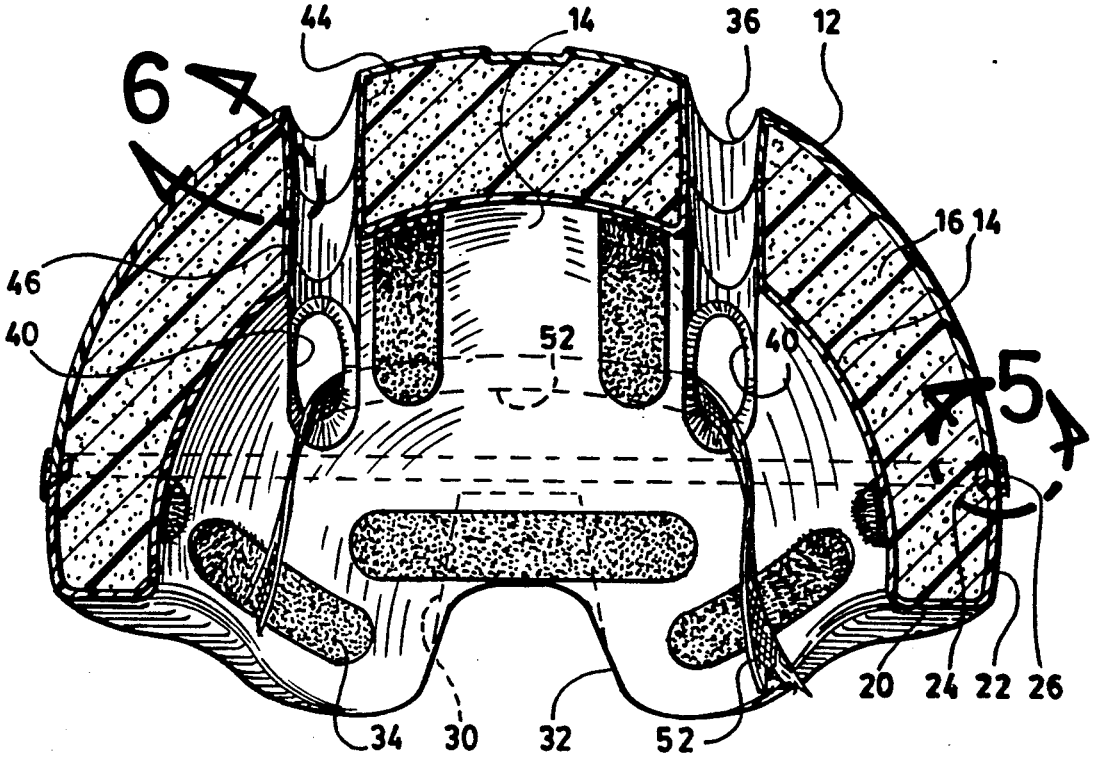
FIG. 4 is a partial cross-section taken along line 4—4 of FIG. 2.
Figure 7:
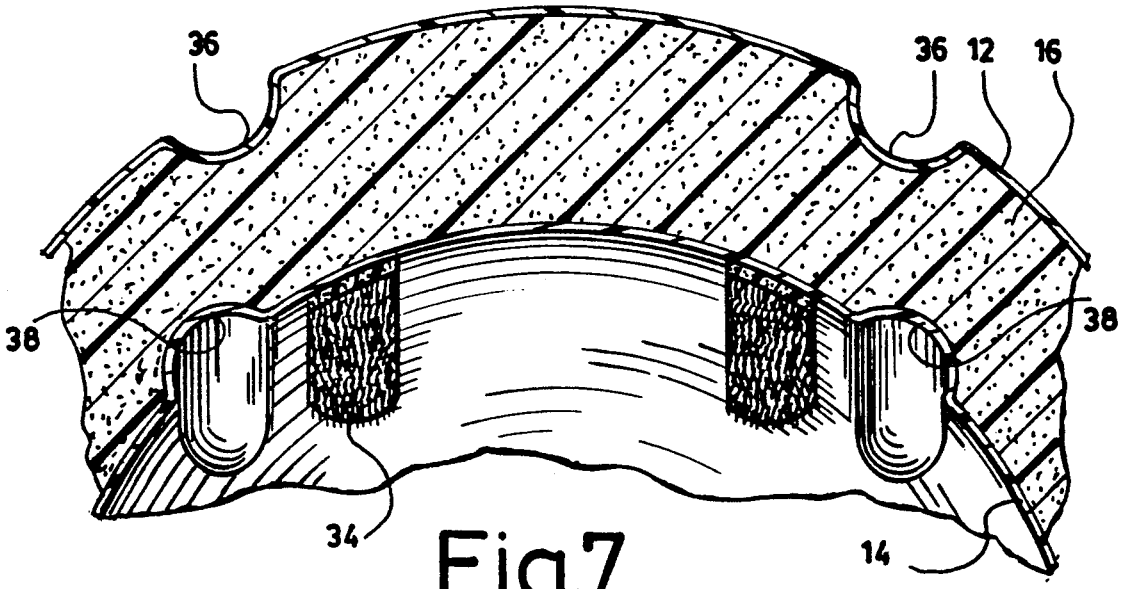
FIG. 7 is an enlarged, partial cross-section, taken along line 7—7 of FIG. 2.
Figure 8:
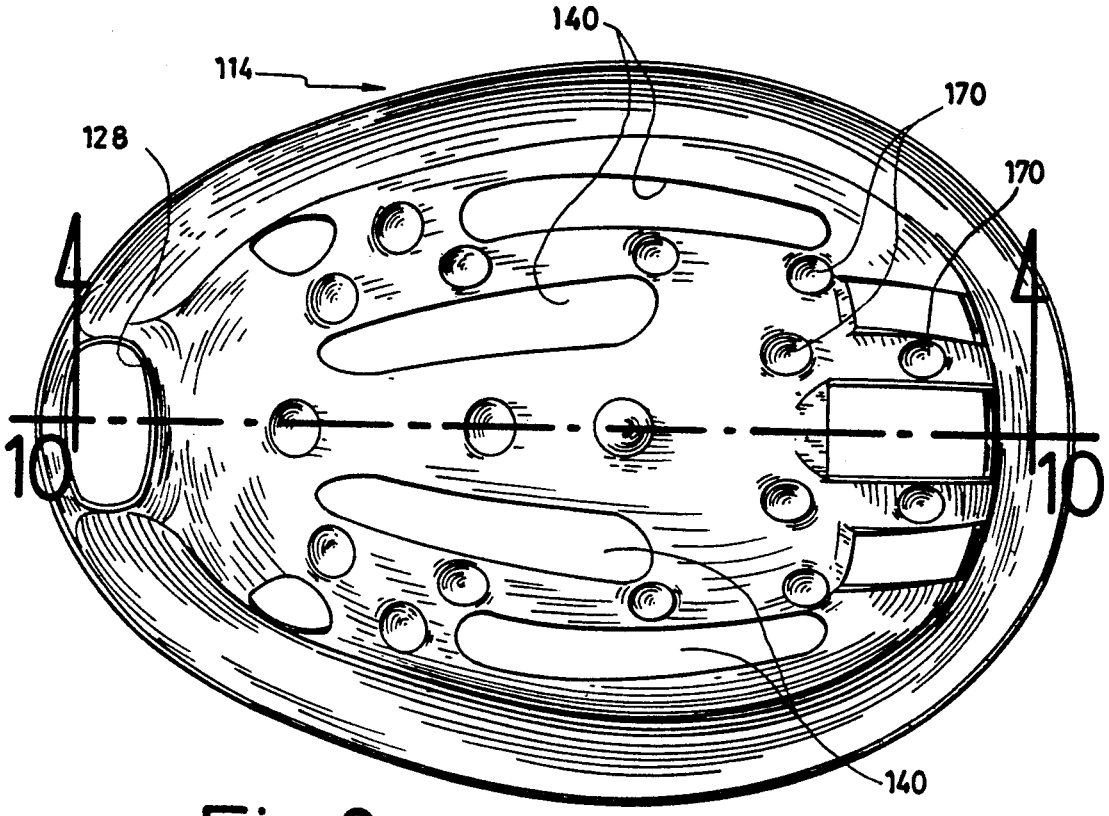
FIG. 8 is a top plan view of a second embodiment of the helmet internal shell part.

Referring to FIG. 3, the rear section of the rim portion 18 (at the left side of the figure) and the corresponding part of the insert 16 is thicker than the front section of rim portion 18 and corresponding part of the insert 16. The rear section of the rim portion 18 is provided with a central orifice 28 defined by an upwardly-extending tubular extension 30, at the top of which is exposed the insert 16. The orifice 28, with its tubular extension 30, is formed in an upwardly-recessed central section 32 of the rim portion 18, as shown in FIG. 4.

Elongated cushioning patches 34 are adhered to the inside surface of the internal shell 14 and are adapted to contact the wearer's head while maintaining the internal shell 14 spaced from said head. Each patch 34 includes velours or terry-like fabric.

To further reinforce the helmet, the external shell 12 is provided with a pair of longitudinally-extending ribs 36, which protrude inwardly from the inner surface of the external shell 12, thereby forming grooves at the outer surface of the latter. Similarly, the internal shell 14 is provided with a pair of longitudinal grooves 38, which protrude outwardly from the external surface of the internal shell toward external shell 12. The ribs 36 and 38 are longitudinally registering and are preferably diverging from back to front of the helmet.

Ventilation openings 40, 42 are formed through the helmet, more specifically through the external shell 12, the insert 16, and the internal shell 14. Ventilation openings 40 are located through the ribs 36, 38, while ventilating openings 42 are disposed along the central plane of the helmet, and also forwardly of the ribs 36 and 38. Obviously, additional ventilation openings could be provided. These ventilation openings are characterized by the fact that their portions formed in the internal shell 14 and external shell 12 are surrounded by tubular extensions 44 and 46, respectively. The extensions 44 inwardly protrude from the external shell 12, while the extensions 46 outwardly protrude from the internal shell 14. The two extensions abut against each other approximately mid-way of the thickness of the insert 16 to form a butt joint 50, as shown in FIG. 6. Thus, the tubular extensions 44 and 46 completely line the surfaces of the insert 16 which would otherwise be exposed in the ventilation openings 40 and 42.

The helmet is provided with retention straps 52, 52*a* of known construction, and including length-adjusters 54 and chin straps 56, the latter only being partially shown. At the back of the helmet, the retaining strap 52 extends through a portion of two transversely-aligned ventilation openings 40 and underneath the external shell 12 through a passage formed by a transverse groove 58, made at the outer surface of the insert 16, and communicating with the two ventilation openings 40. Similarly, a pair of transversely-spaced strap-receiving orifices 60 are formed at the front of the helmet for the passage of the retaining strap 52*a*. The two orifices 60 communicate with a transverse passage formed by a groove 62 at the outer surface of the insert 16.

The internal and external shells 14 and 12 are separately molded; the internal shell 14 is inserted in a mold in which is injected the material of the insert 16, the polystyrene then expanding within the mold to its final shape and adhering to the outer surface of the hot internal shell 14. The resulting assembly, once cured, is covered with the external shell 12 which is adhered to the insert 16 after the positioning of the retaining straps 52, 52*a*. The patches 44 are finally positioned on the internal shell 14. The resulting helmet is very light; it has a minimum of thickness and fully complies with the regulations governing the resistance to impact of such helmets.

Figure 9:
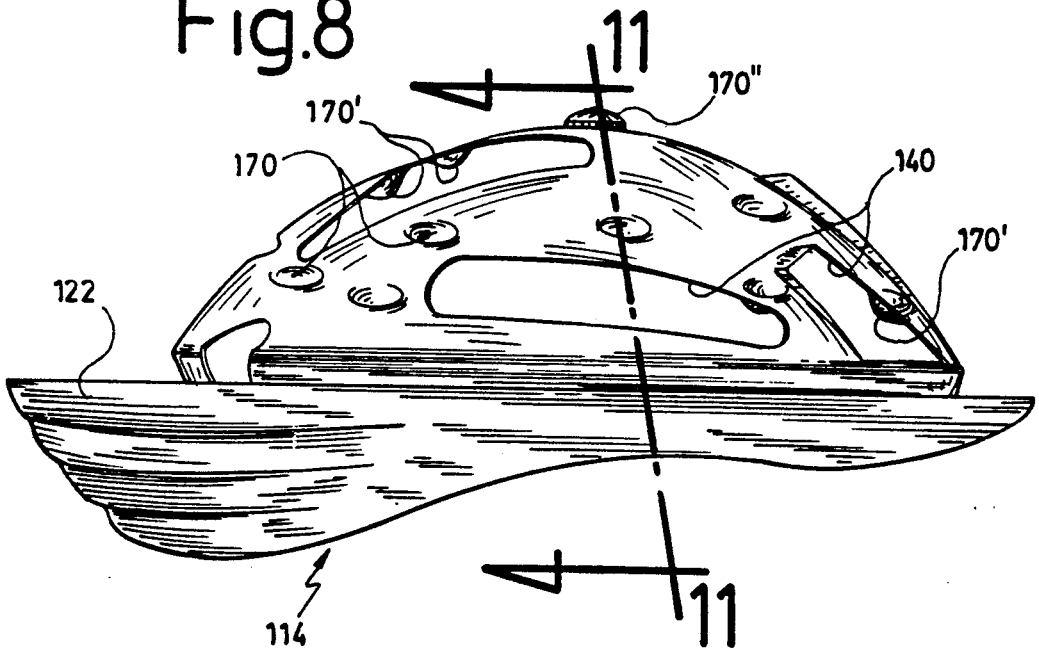
FIG. 9 is a side elevational view of the internal shell of FIG. 8.
Figure 10:
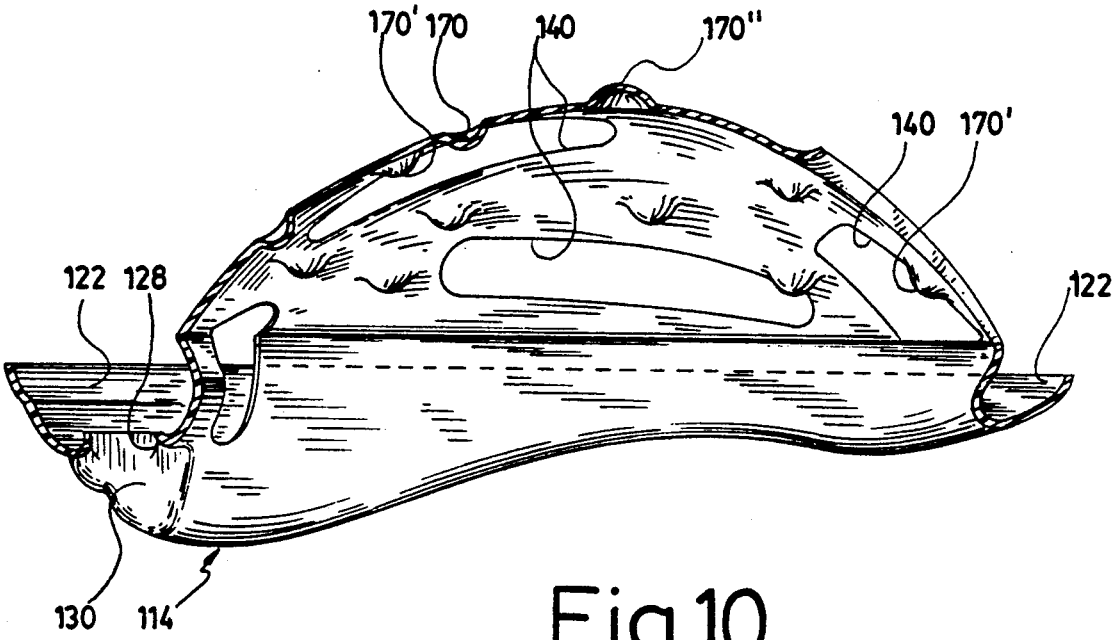
FIGS. 10 and 11 are sectional views of the internal shell taken along lines 10—10 and 11—11 respectively of FIG. 9.
Figure 11:
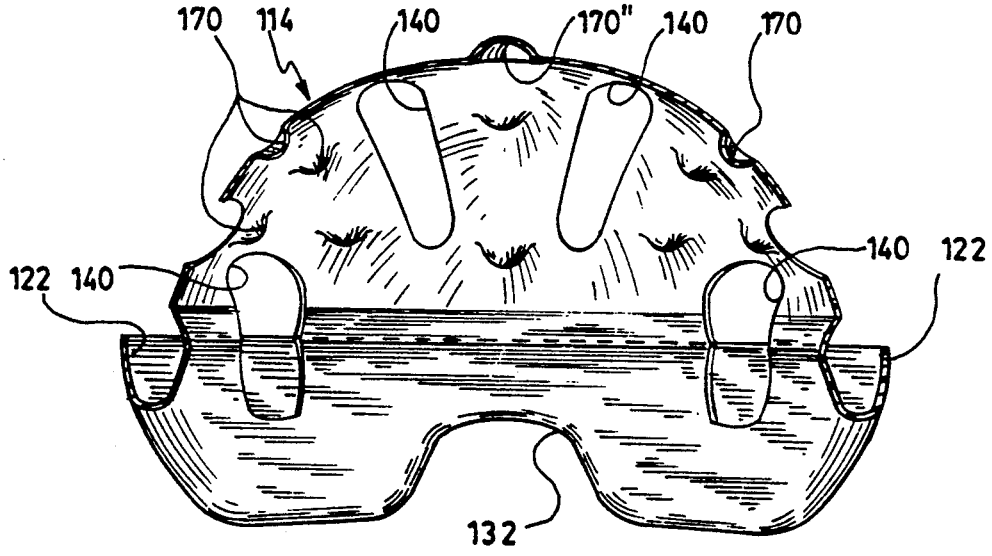
Figure 10A:
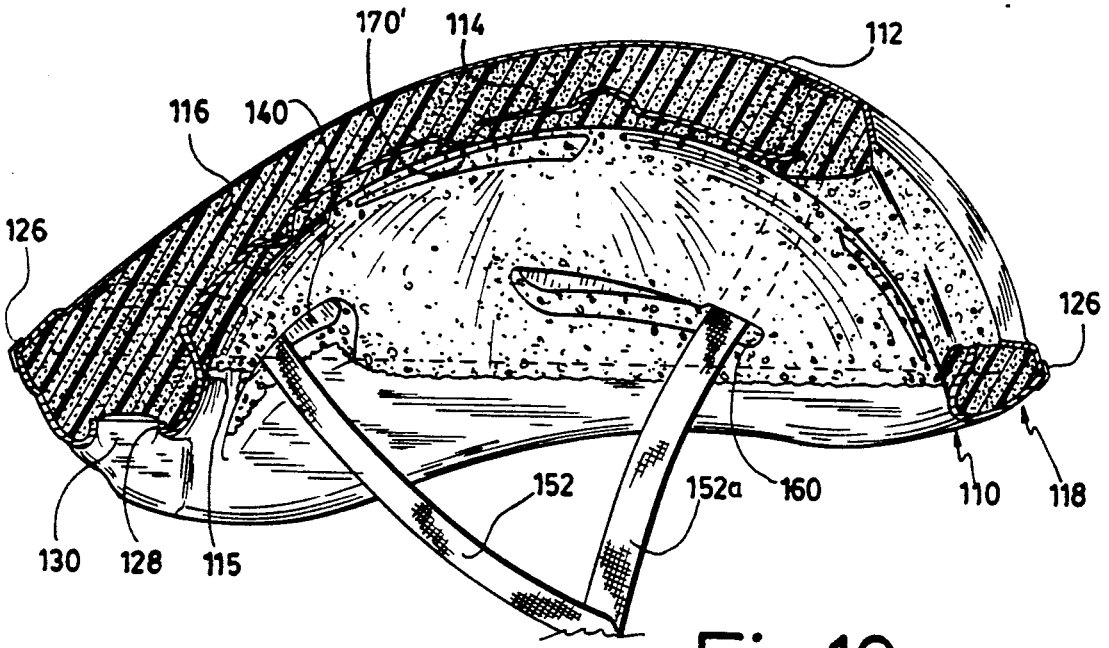
FIGS. 10*a* and 11*a* are views similar to FIGS. 10 and 11 respectively, but showing the helmet in full including the insert and the external shell thereof.
Figure 11A:
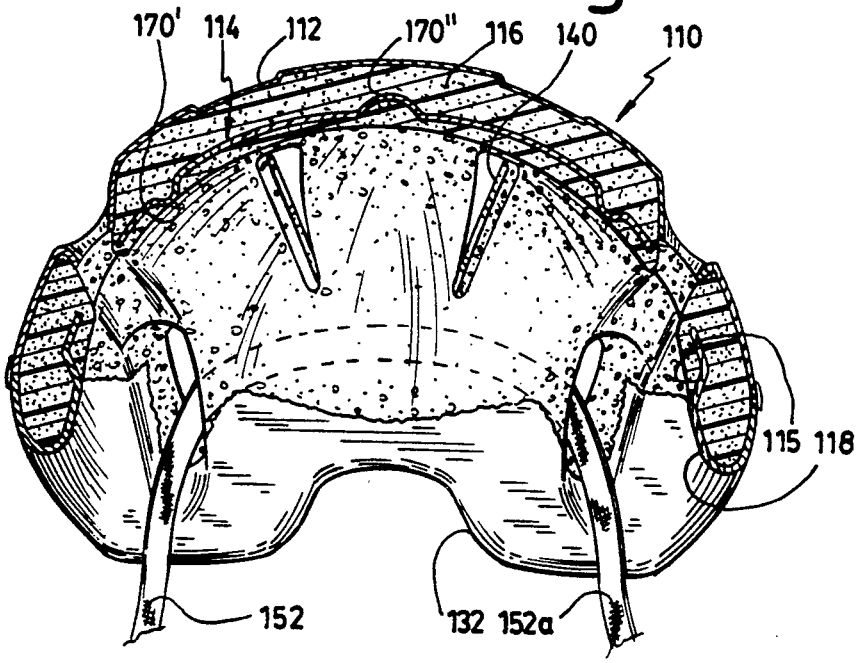

The second embodiment of helmet is illustrated at 110 in FIGS. 10*a* and 11*a*, and referenced with the 100-series reference numerals corresponding to those of the first embodiment. Namely, the alternate internal shell 114—FIGS. 8–11—is made of a hard yet resiliently flexible material, similar to that of shell 14 of the first embodiment; however, its relative hardness will be substantially smaller. Preferably, shell 114 could then have a reduced thickness, e.g. 0.1 mm (about one third the thickness of shell 14).

A second difference between the two internal shells is that shell 114 has preferably a much larger number of ventilation openings 140 formed therethrough.

The third and main difference between the internal shells is however in the way the internal shell 114 is mounted to the insert 116. Indeed, as best seen in FIGS. 10*a* and 11*a*, the main portion of shell 114 is thickness-wisely embedded into insert 116, while the rim portion 118 of shell 114 is not—rim portion 118 forms an upwardly opening trough completely filled by the bottom edgewise portion of the insert 116. Thus, the main, generally concave wall of internal shell 114 is concealed within the thickness of the insert 116, so that it is the inner wall of insert 116, and not the internal shell 114, that will come in contact with the top portion of the cyclist's head—except at the rim portion where internal shell portion 118 will project outwardly from the thickness of the insert 116 to engage around the side portions of the wearer's head in the known fashion.

A marginal annular portion 115 is thus defined on the inside face of the helmet 110, adjacent the rim portion 118, where the internal shell 114 transversely engages through the soft body of the insert 116 to become thicknesswisely embedded therein. Preferably, this marginal portion 115 will come flush with the internal wall of the insert 16, so as to define a smooth, non-irritating, inner surface joint for comfort of the wearer.

Thus, as in the first embodiment of helmet 10, there are in the second embodiment of helmet 110 two hard shells 112, 114 and one shock absorbing insert, 116. However, while in the first embodiment 10, all of the inner (concave) face of the helmet was lined with the internal shell 14, in the second embodiment 110, only the marginal rim portion 118 of the helmet is lined by the internal shell 114 while the major portion of its inner face is lined by the insert proper 116. The advantage of having the internal shell 114 partially embedded into the soft bodied, yet substantially rigid insert 116, is in the impact absorbing capabilities of the helmet 110. Indeed, with the second embodiment of helmet 110, what will be enhanced is the capability of maintaining together a number of structural fragments of external shell 112 and/or internal shell 114 and/or insert 116, following impact fracturing of the helmet 110. Obviously, internal shell 114, which is embedded into the insert 116 (the latter covering the wearer's head), still provides a structural function for the helmet 110, in that it has a synergistic effect with the external shell 112 and insert 116, in providing very high impact resistance, as in the first embodiment of the invention.

Maintaining together these various fragments of helmet 110 after impact, even if in non-integral fashion, is critical in providing post-impact sustained protection to the head in view of eventual secondary ground impacts of the cyclist's head following the initial impact. Indeed, the purpose of the helmet is to prevent head injuries, which usually occur when the cyclist loses control of his vehicle and falls to the ground. If the helmet becomes shattered and disintegrates after the initial ground impact, it will not help prevent head injuries if the cyclist's head strikes the ground for a second or third time—which could occur of course when the cyclist speed is relatively high before fall.

Preferably, and as best illustrated in FIG. 9, the outer face of the main concave wall portion of internal shell 114 is poked at a plurality of random locations, to define a plurality of inwardly projecting cavities 170. Such cavities 170 define on the internal face of the internal shell 114, full convex "fingers" 170' (the mirror image of the cavities 170). Cylindrical fingers 170' are destined to sink into the soft body of the insert 116 so as to more firmly anchor the shell 114 into the insert 116. The apex of the internal shell 114 preferably also includes an outturned cylindrical finger 170'' with a conical tip, extending in a direction opposite fingers 170', for the same purpose as the latter.

Preferably and as suggested in FIGS. 10*a* and 11*a*, the apices of outturned fingers 170' project through the inner face of the insert 116, so as to come flush with the inner face of insert 116. Hence, the inner face of soft-bodied insert 116 is dotted with a number of small discs 170' made of hard material and spaced from each other.

I claim:

1. A safety helmet for cyclists, comprising a hard external shell, a hard internal shell, and an intermediate shock-absorbing insert, said internal shell conforming with and adapted to fit the head of a wearer, and defining a bottom rim portion formed by an outwardly-extending web and a flange projecting upwardly from said web, said bottom rim portion thus defining an upwardly-opening trough, said insert conforming with and adhering to the outer surface of said internal shell and filling said trough, said insert having an external surface which is substantially flush with said flange, said external shell intimately conforming with, and adhering, to the external surface of said insert and having a bottom edge forming a joint with the top edge of said flange, and ventilation openings extending through said internal shell, insert and external shell, wherein said rim portion has a front and a rear section adapted to extend across the forehead and the back of the head of the wearer, respectively, said insert being thicker at said rear section than at said front section, the web of said rear section having an orifice defined by a tubular extension upwardly extending in said trough and said insert being exposed in said orifice at the upper end of said tubular extension.

* * * * *